US006789762B1

(12) United States Patent
Schneider

(10) Patent No.: US 6,789,762 B1
(45) Date of Patent: Sep. 14, 2004

(54) METHOD AND DEVICE FOR WINDING CABLE ONTO A CABLE DRUM

(75) Inventor: Reiner Schneider, Ebersdorf (DE)

(73) Assignee: CCS Technology, Inc., Wilmington, DE (US)

( * ) Notice: Subject to any disclaimer, the term of this patent is extended or adjusted under 35 U.S.C. 154(b) by 0 days.

(21) Appl. No.: 10/129,469

(22) PCT Filed: Nov. 9, 2000

(86) PCT No.: PCT/DE00/03915

§ 371 (c)(1),
(2), (4) Date: Oct. 15, 2002

(87) PCT Pub. No.: WO01/34509

PCT Pub. Date: May 17, 2001

(30) Foreign Application Priority Data

Nov. 10, 1999 (DE) ..... 199 54 072

(51) Int. Cl.[7] ..... B65H 54/28
(52) U.S. Cl. ..... 242/478.2; 242/485.1
(58) Field of Search ..... 242/470, 478.2, 242/485.1, 485.6

(56) References Cited

U.S. PATENT DOCUMENTS

| | | | | | |
|---|---|---|---|---|---|
| 3,876,167 | A | * | 4/1975 | Nittschalk et al. | 242/478.2 |
| 4,410,147 | A | * | 10/1983 | Seibert | 242/478.2 |
| 4,570,875 | A | * | 2/1986 | Buluschek | 242/478.2 |
| 4,928,904 | A | | 5/1990 | Watts | |
| 6,209,817 | B1 | * | 4/2001 | Conrad et al. | 242/534 |
| 6,443,385 | B1 | * | 9/2002 | Grandauer et al. | 242/478.2 |

FOREIGN PATENT DOCUMENTS

| | | |
|---|---|---|
| DE | 1574422 | 7/1971 |
| DE | 19726285 A1 | 12/1998 |
| EP | 0043366 B1 | 4/1986 |

* cited by examiner

*Primary Examiner*—Evan H Langdon

(57) ABSTRACT

An apparatus and method for winding cables onto a rotatably driven cable drum without gaps, an oncoming cable being wound in a new coil directly next to the preceding coil at the running-on point, and the running-on angle of the cable being corrected if a monitoring device finds a gap between the last coils. A marking that changes over time is applied to the cable by a marking device before it is wound, and in the marking is detected at least in the new coil and the preceding coil, it being possible for the new coil to be differentiated from the preceding coil.

12 Claims, 1 Drawing Sheet

METHOD AND DEVICE FOR WINDING CABLE ONTO A CABLE DRUM

FIELD OF THE INVENTION

Figure 1:
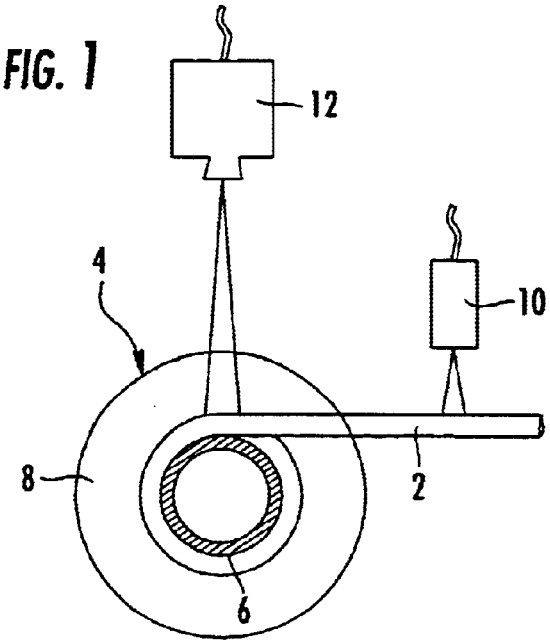

The invention relates to a method for winding cables onto a rotatably driven cable drum without gaps, an oncoming cable being wound in a new coil directly next to the preceding coil at the running-on point, and the running-on angle of the cable being corrected if a monitoring device finds a gap between the last coils.

BACKGROUND OF THE INVENTION

In controlled cable laying, the cable is wound onto the cable drum while the drum is displaced virtually continuously in the axial direction. The displacement per drum revolution is approximately one cable diameter. If need be, this laying is at the same time subjected to the laying correction. The laying correction is carried out with a driven cable guiding device, which may have, for example, a laying hand or a guiding roller.

EP-B10043366 discloses a method for winding cable onto a cable drum in which the cable is continuously supplied in such a way that the most uniform possible winding is achieved. A television camera is provided for the monitoring of the position of the cable, and the data determined by the television camera concerning the respective position of the coil is fed to a computer, which instigates the corresponding laying correction. In this case, a video camera which is used as a first measuring device for the monitoring and directed approximately tangentially onto the wound layer senses the wound layer, which is possibly illuminated by a lamp. In this case, the position of the coil flank of the last-wound coil is determined by the video camera, to be precise at a point lying away from the running-on point of the cable by a certain angle of spool rotation. Furthermore, a measuring device for sensing the respective changing position of the cable drum and a sensor for the cable are provided. From the measurement data of the two measuring devices, the relative positions which the cable drum and the guiding device for the cable must have reached after the turning of the cable drum to maintain the running-on angle are calculated. A control device serves the purpose of maintaining a constant running-on angle for laying the coil within each wound layer.

To allow a laying correction which is comparatively simpler, and as quick and efficient as possible, to be carried out, it is known from DE 19726285.6 A1 to determine for at least two coils of the new wound layer, in relation to the cable drum axis seen in the radial direction, in each case the position of the vertex points of these coils and, in the event of a deviation of these vertex points from a setpoint value, to carry out a laying correction reducing the deviation. In this case, the distance between the vertex points of these coils is respectively determined for at least two coils of the new wound layer in the region of the point of contact of the cable, seen in the direction parallel to the cable drum axis. If the gap between the last-but-one and the last coil increases, and as a result the distance between the neighboring vertex points increases, a laying correction is carried out to the effect that the lateral spacing of the last coil with respect to the last-but-one coil is reduced.

The known methods of laying correction can be used as long as the cables are wound onto the cable drum in an orderly way. At relatively high speeds, however, there is the risk of the cable jumping as it is wound on or of the cables crossing as they are wound on. This gives rise to the problem that the devices which are intended to carry out the automatic laying correction no longer have information on which was the last coil and the last-but-one coil during the winding of the cable. The automatic laying correction can then no longer be carried out in the intended way.

BRIEF SUMMARY OF THE INVENTION

Against this background, the invention is based on the object of providing a method and an apparatus for winding cable onto a cable drum without gaps and with fully automatic laying correction, which is intended to offer the possibility of differentiating the last coil and the last-but-one coil from one another and consequently finding winding errors which previously could not be dealt with.

To achieve this object, the method stated at the beginning is characterized in that a marking that changes over time is applied to the cable before it is wound, and in that the state of the marking is detected at least in the new coil and the preceding coil, it being possible for the new coil to be differentiated from the preceding coil. Consequently, in the case of the method according to the invention, a marking that changes over time and the state of which is detected to allow the coil currently being produced to be clearly differentiated from the coil wound on immediately before is applied during the winding of the cable. The cable can therefore be wound with automatic laying correction even in cases which, as explained above, previously could not be dealt with. The method according to the invention has the effect of achieving wound units built up layer by layer, with the coils of cable lying closely next to one another. A manual laying correction is no longer required. Rather, the cable guiding device guides the running-on cable into the set position next to the last coil, and, while the cable deviates from the desired position, the required laying correction is automatically performed.

An advantageous refinement of the method according to the invention is characterized in that the marking is produced by the surface of the cable being heated, and by the thermal radiation of the cable in the new coil and the preceding coil being detected. The cable surface is consequently heated briefly before the cable is wound onto the cable drum, and the temperature of the running-on cable is compared with the temperature of the neighboring cable coil, the second-highest temperature being found in the case of the previously wound-on coil. The previously wound-on coils have a virtually continuous or exponential cooling function corresponding to lower surface temperatures. Consequently, the coils of the cable can be differentiated according to their winding sequence.

An advantageous refinement of the method according to the invention is characterized in that the marking is produced by the surface of the cable being cooled, and by the thermal radiation of the cable in the new coil and the preceding coil being detected. A cold marking is advantageous in particular whenever the cable surface is significantly warmer than the temperature in the cable during winding. In such a case, it could otherwise happen that the heat transfer from the interior of the cable to its surface impairs the desired differentiation, or makes it impossible.

A further advantageous refinement of the method according to the invention is characterized in that water at a temperature below room temperature is used for the cooling. Water is a medium which can be used safely for this purpose.

A further advantageous refinement of the method according to the invention is characterized in that liquid nitrogen is used for the cooling, whereby a great temperature difference with respect to the surroundings can be advantageously established in a very short time, so that the different thermal radiations of the different coils can be clearly detected.

A further advantageous refinement of the method according to invention is characterized in that the marking is produced by the surface of the cable being finished with a substance which, after appropriate stimulation, has a radiation which subsides over time, and in that the radiation of the cable in the new coil and the preceding coil is detected. Depending on the type of substance and its stimulation, in such a case the changes in the radiation can also be detected from a relatively great distance.

A further advantageous refinement of the method according to the invention is characterized in that phosphorus, which can be stimulated with little energy and has sufficiently strong radiation, is used as the finishing substance.

A further advantageous refinement of the method according to the invention is finally characterized in that the marking is produced by the surface of the cable being coated with a dye which changes its color as it dries out over time, and in that the color of the cable in the new coil and the preceding coil is detected. A change in color can also be detected from a relatively great distance, as can the mentioned change in radiation.

To achieve the stated object, an apparatus for carrying out the method is characterized by a marking device which applies a marking that changes over time to the cable before it is wound, and by a detector device, which detects the state of the marking at least in the new coil and the preceding coil, it being possible for the new coil to be differentiated from the preceding coil. The set object can consequently be achieved with a virtually static means.

An advantageous refinement of the apparatus according to the invention is characterized by a heating device, which heats up the surface of the cable, and by a heat detector, which detects the thermal radiation of the cable in the new coil and the preceding coil. Such heating devices and heat detectors are commonly used components which can be used with low costs.

Heating sleeves and the like are conceivable as heating devices. However, an advantageous refinement of the apparatus according to the invention is characterized in that an infrared radiator is provided as the heating device and an infrared sensor is provided as the detector. This apparatus is distinguished in an advantageous way by a high level of safety and low operating costs.

However, an advantageous refinement of the apparatus according to the invention is characterized in that the heating device has a heated deflecting roller, which last touches the cable at the outer-lying surface on the cable drum, no additional parts being required for the heating of the cable.

An advantageous refinement of the apparatus according to the invention is characterized by a cooling device, by which the surface of the cable is cooled, and by a detector device, by which the thermal radiation of the cable in the new coil and the preceding coil is detected. An apparatus of this type can also be realized with low costs and it also entails a very low safety risk.

An advantageous refinement of the apparatus according to the invention is characterized in that the cooling device comprises a device with the aid of which the surface of the cable is blasted with cold gases or wetted with cold liquids. In this way, great temperature differences can be produced in an extremely short time, so that the detection results are correspondingly clear.

However, an advantageous refinement of the apparatus according to the invention is characterized in that the cooling device has a cooled deflecting roller, which last touches the cable at the outer-lying surface on the cable drum, no additional parts being required for the heating of the cable.

A further advantageous refinement of the apparatus according to the invention is characterized by a marking device, by which the surface of the cable is finished with a substance which, after appropriate stimulation, has a radiation which subsides over time, and by a radiation detector device, by which the radiation of the cable in the new coil and the preceding coil is detected. Depending on the type of radiation, the corresponding cable coils can be detected without relatively great temperature differences having to be produced on the surface of the cable, which, depending on the surroundings, can present difficulties.

Finally, an advantageous refinement of the apparatus according to the invention is characterized by a coating device, by which the surface of the cable is coated with a dye which changes its color as it dries out over time, and by a color detecting device, by which the color of the cable in the new coil and the preceding coil is detected. Such optical changes can also be reliably detected at a relatively great distance, and the application of a color to the surface of the cable does not involve any safety risk.

BRIEF DESCRIPTION OF THE DRAWING FIGURES

Figure 1A:
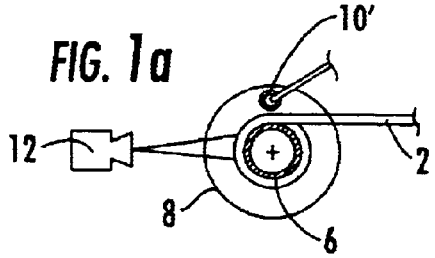
Figure 2:
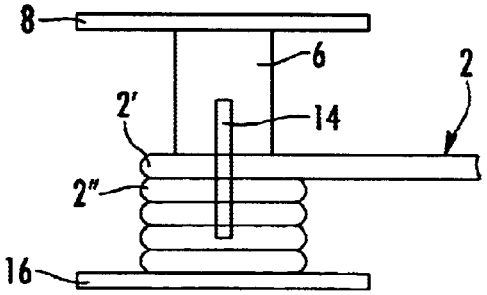

FIG. 1 shows a side view of a partly sectioned cable drum with a cable, a marking device and a detector device;

FIG. 1*a* shows a side view of a partly sectioned cable drum with a cable, a roller as the marking device and a detector device; and FIG. 2 shows a schematic representation of a cable drum with a wound-on cable in a first wound layer.

DETAILED DESCRIPTION OF THE INVENTION

FIG. 1 shows in a partly sectioned side view an exemplary embodiment of the apparatus according to the invention for winding a cable 2 onto a cable drum 4 without gaps. The cable drum 4 has a drum 6 and a flange 8. Provided at the oncoming cable 2 is a marking device 10, which applies a marking to the cable 2. A detector device 12 detects the state of the marking, at least in the new coil 2' (FIG. 2) and the preceding coil 2", as indicated by the detection window 14 in FIG. 2.

Depending on the type of marking, the marking device 10 may be heating device, a cooling device, a device which finishes the surface of the cable with a substance which, after appropriate stimulation, has a radiation subsiding over time, or a dye coating device. The detector device 12 is correspondingly made to match the marking substance and detects the thermal radiation of the cable coils 2', 2", other radiation, for example phosphorescence, or the color of the coils 2', 2".

If, as in this exemplary embodiment, the cable drum 4 is moved in its axial direction to produce a wound layer on the drum 6, the marking device 10 and the detector device 12 are arranged fixed in place above the oncoming cable 2. If, on the other hand, the cable drum 4 is arranged fixed in place, the marking device 10 and the detector device 12 may be moved along with the oncoming cable 2.

If, during winding, the cable coil currently being produced reaches the drum flange 8 or the other drum flange 16

(FIG. 2), the cable is held in this position near the flange until the cable drum has turned further by about 320 degrees in the winding direction. Following that, the running-on cable is positioned away from the flange by the distance of a cable diameter. From this point in time, the winding position is again controlled in such a way that the running-on cable with the highest temperature, if the marking device 10 is a heating device, comes to lie laterally correctly next to the second-warmest cable. This transition takes into account the fact that the coil which is wound over the last coil at the flange covers the coil lying thereunder, so that the direct sequence of the two coils cannot be found or detected at this instant.

An advantageous refinement of the apparatus according to the invention is characterized in that the cooling device has a cooled deflecting roller 10', which last touches the cable 2 at the outer-lying surface on the cable drum, no additional parts being required for the heating of the cable.

What is claimed is:

1. A method for winding cables onto a rotatably driven cable drum without gaps, an oncoming cable being wound in a new coil directly next to the preceding coil at the running-on point, and the running-on angle of the cable being corrected if a monitoring device finds a gap between one or more of the preceding coils, a marking that changes over time is applied to the cable before it is wound, and the marking is detected at least in the new coil and the preceding coil, wherein the marking on the new coil is thermally differentiated from one or more of the preceding coils.

2. The method as claimed in claim 1, the marking is produced by the surface of the cable being heated, and by the thermal radiation of the cable in the new coil and the preceding coil being detected.

3. The method as claimed in claim 1, the marking is produced by the surface of the cable being cooled.

4. The method as claimed in claim 3, water at a temperature below room temperature is used for the cooling.

5. The method as claimed in claim 3, liquid nitrogen is used for the cooling.

6. An apparatus for winding cable onto a rotatably driven cable drum without gaps, an oncoming cable being wound in a new coil directly next to the preceding coil at a running-on point, and the running-on angle of the cable being corrected if a monitoring device finds a gap between one or more of the preceding coils, the apparatus including a marking device which applies a marking that changes over time to the cable before it is wound, and a detector device, which detects the state of the marking at least in the new coil and the preceding coil, wherein the marking on the new coil is thermally differentiated from one or more of the preceding coils.

7. The apparatus as claimed in claim 6, the apparatus including a heating device, which heats up the surface of the cable, and by a heat detector, which detects the thermal radiation of the cable in the new coil and the preceding coil.

8. The apparatus as claimed in claim 7, wherein an infrared radiator is provided as the heating device and an infrared sensor is provided as the detector.

9. The apparatus as claimed in claim 7, the heating device has a heated deflecting roller, which last touches the cable at the outer-lying surface on the cable drum.

10. The apparatus as claimed in claim 6, the apparatus including a cooling device for cooling a surface of the cable.

11. The apparatus as claimed in claim 10, wherein the cooling device comprises a device that directs cold gases toward the cable or that wets the cable with cold liquids.

12. The apparatus as claimed in claim 10, wherein the cooling device has a cooled deflecting roller.

* * * * *